US010041400B2

(12) United States Patent
Taylor et al.

(10) Patent No.: US 10,041,400 B2
(45) Date of Patent: Aug. 7, 2018

(54) HOLLOW FILLED TURBOCHARGER ROTOR SHAFT

(71) Applicant: BorgWarner Inc., Auburn Hills, MI (US)

(72) Inventors: Andrew Taylor, Mirfield (GB); Andrew Thompson, Leeds (GB)

(73) Assignee: BorgWarner Inc., Auburn Hills, MI (US)

( * ) Notice: Subject to any disclaimer, the term of this patent is extended or adjusted under 35 U.S.C. 154(b) by 94 days.

(21) Appl. No.: 15/160,119

(22) Filed: May 20, 2016

(65) Prior Publication Data

US 2017/0335759 A1 Nov. 23, 2017

(51) Int. Cl.

| | |
|---|---|
| ***F02B 39/00*** | (2006.01) |
| ***F01D 25/28*** | (2006.01) |
| ***F01D 25/16*** | (2006.01) |
| ***F02B 39/14*** | (2006.01) |
| ***F01D 25/00*** | (2006.01) |

(Continued)

(52) U.S. Cl.

CPC ..... *F02B 39/005* (2013.01); *F01D 25/005* (2013.01); *F01D 25/125* (2013.01); *F01D 25/16* (2013.01); *F01D 25/18* (2013.01); *F01D 25/28* (2013.01); *F02B 39/14* (2013.01); *F05D 2220/40* (2013.01); *F05D 2240/61* (2013.01); *F05D 2260/20* (2013.01)

(58) Field of Classification Search

CPC ..... F02B 39/005; F02B 39/14; F01D 25/28; F01D 25/16; F01D 25/125; F01D 25/005; F01D 25/18; F05D 2260/20; F05D 2240/61; F05D 2220/40

USPC ..... 60/605.1, 605.2; 415/216.1

See application file for complete search history.

(56) References Cited

U.S. PATENT DOCUMENTS

| | | | |
|---|---|---|---|
| 3,376,918 | A | 4/1968 | Desire et al. |
| 3,968,389 | A | 7/1976 | Albaric et al. |
| 4,190,398 | A | 2/1980 | Corsmeier et al. |

(Continued)

FOREIGN PATENT DOCUMENTS

| | | | |
|---|---|---|---|
| CN | 103925010 | * | 12/2013 |
| DE | 102004053424 | A1 | 5/2006 |

(Continued)

OTHER PUBLICATIONS

Rotating Heat Pipe Ponnappan/Wright Laboratory Sep. 17, 1996.

*Primary Examiner* — Hoang Nguyen

(74) *Attorney, Agent, or Firm* — Young Basile Hanlon & MacFarlane, P.C.

(57) ABSTRACT

A turbocharger rotor shaft assembly and associated turbocharger that includes at least one turbine rotor member having a first face and an opposed second face; and a rotor shaft having a first end and an opposed second end distal from the first end, wherein the rotor shaft is connected to the at least one turbine rotor at a location proximate to the first end and projects outward therefrom, the rotor shaft having an outwardly oriented face and an interior chamber defined therein, the interior chamber having an interior chamber volume. The turbocharger rotor shaft also includes at least one thermal transfer material contained in the interior chamber of the rotor shaft that has a thermal conductivity value that is greater than the thermal conductivity value of the material of construction of the rotor shaft.

20 Claims, 4 Drawing Sheets

(51) Int. Cl.
*F01D 25/12* (2006.01)
*F01D 25/18* (2006.01)

(56) References Cited

U.S. PATENT DOCUMENTS

| | | | | | |
|---|---|---|---|---|---|
| 4,784,574 | A * | 11/1988 | Tsuno | F01D 5/025 | 403/30 |
| 5,149,141 | A | 9/1992 | Newhouse | | |
| 5,189,325 | A | 2/1993 | Jarczynski | | |
| 5,937,708 | A * | 8/1999 | Ito | F16D 1/068 | 403/30 |
| 6,354,083 | B1 * | 3/2002 | Shuttleworth | F01D 25/125 | 60/597 |
| 7,528,510 | B2 | 5/2009 | Frank et al. | | |
| 7,640,648 | B1 | 1/2010 | Rittenhouse | | |
| 7,723,891 | B2 | 5/2010 | Rittenhouse | | |
| 8,491,271 | B2 * | 7/2013 | Jennes | B23K 28/00 | 415/216.1 |
| 2005/0257522 | A1 * | 11/2005 | Fremerey | F01D 25/145 | 60/605.3 |
| 2010/0329887 | A1 | 12/2010 | Eifert | | |

FOREIGN PATENT DOCUMENTS

| | | | |
|---|---|---|---|
| EP | 0688090 | A1 | 12/1995 |
| EP | 1647671 | A1 | 4/2006 |
| EP | 1785587 | A1 | 5/2007 |
| FR | 2888882 | A3 | 1/2007 |
| WO | 2014175766 | A1 | 10/2014 |

* cited by examiner

HOLLOW FILLED TURBOCHARGER ROTOR SHAFT

TECHNICAL FIELD

This disclosure pertains to turbochargers, and more particularly, a turbocharger having a hollow rotor shaft filled with a thermal transfer material to provide enhanced thermal control and transfer characteristics.

BACKGROUND

Turbochargers are forced induction devices that are used to increase intake air pressure to an internal combustion engine. By increasing the air intake pressure, an increase in the power output of the internal combustion engine can be achieved.

In operation, exhaust gases from the engine are routed to the turbocharger to rotate an associated turbine wheel that drives a compressor. The compressor pressurizes ambient intake air to the engine such that the amount of air and fuel that can be forced into each cylinder of the internal combustion engine during an intake stroke of the engine can be increased. Engine exhaust gas employed to operate the turbocharger results in elevated temperature in the turbocharger components. Elevated turbocharger operating temperature can compromise turbocharger performance and durability due to various phenomena such as coking and seal failure. The exhaust gases driving the turbine can cause localized elevated temperatures at the rotor, sometimes reaching levels between 900° and 1000° C. These elevated temperatures can contribute to coking and associated bearing wear of the turbocharger. In some extreme situations, the temperature of the rotor can exceed the temperature at which elastomeric materials in associated seals degrade. It would be desirable to provide a turbocharger capable of effective and balanced heat transfer.

SUMMARY

A turbocharger rotor shaft assembly and an associated turbocharger are disclosed that include at least one turbine rotor member having a first face and an opposed second face, and a rotor shaft having a first end and an opposed second end distal to the first end. The rotor shaft is connected to the at least one turbine rotor at a location proximate to the first end and projects outward from the first face of that turbine rotor. The rotor shaft has an outwardly oriented face and an interior chamber defined therein, wherein the interior chamber has an interior chamber volume. The rotor shaft also includes at least one thermal transfer material contained in the interior chamber that has a thermal conductivity value that is greater than the thermal conductivity value of the material of construction of the rotor shaft.

These and other aspects of the present disclosure are disclosed in the following detailed description of the embodiments, the appended claims and the accompanying figures.

BRIEF DESCRIPTION OF THE DRAWING

The present disclosure is best understood from the following detailed description when read in conjunction with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION

Figure 1:
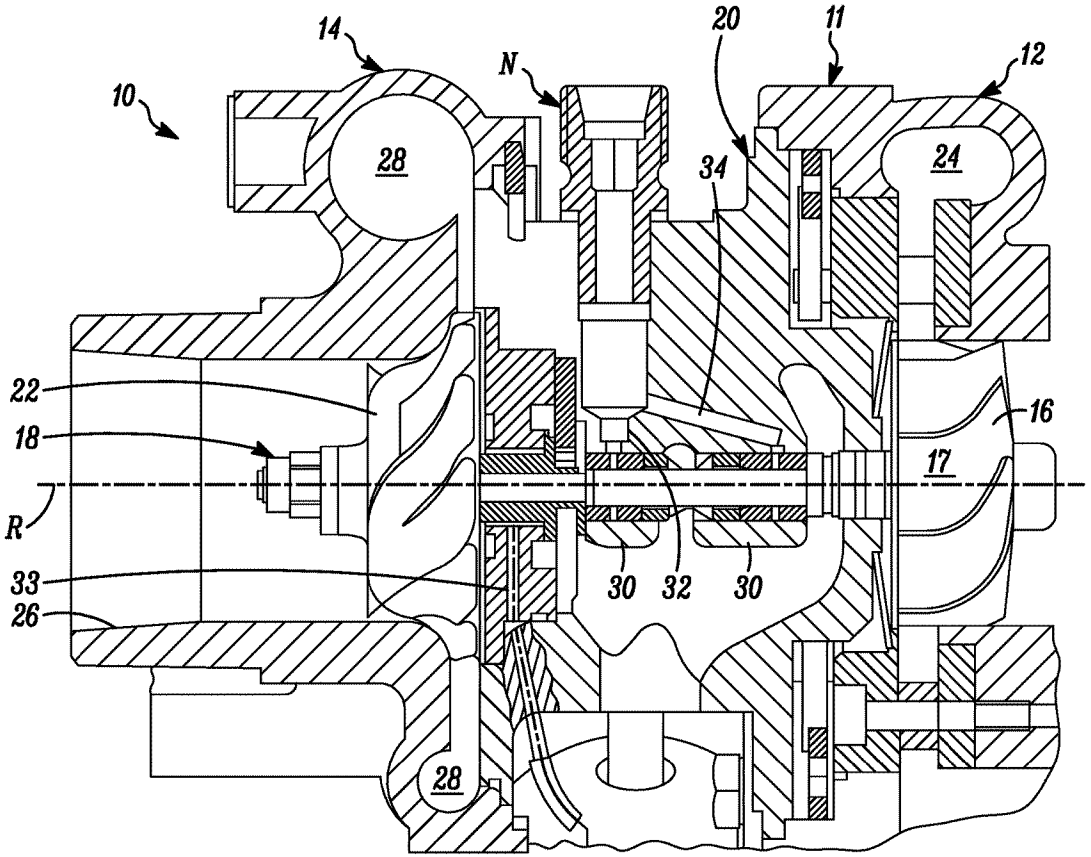
FIG. 1 is a partial axial cross-sectional view of a representative turbocharger as disclosed herein.

A representative turbocharger 10, as shown in FIG. 1, includes a housing 11 composed of a turbine housing section 12 and a compressor housing section 14 arranged along an axis of rotation R. Together, the turbine housing section 12 and the compressor housing section 14 are configured to contain a turbine rotor assembly 16 that is situated on and rotatable about the axis of rotation R. The turbine rotor assembly 16 includes a turbine rotor 17 that is fastened to one end of a rotor shaft 18. The rotor shaft 18 is supported in a central housing section 20 located between the turbine housing section 12 and the compressor housing section 14. The term "end" of the rotor shaft 18 as used herein is taken to mean a portion of the rotor shaft 18 that projects into the respective turbine housing section 12 at one end of the rotor shaft 18 and into the compressor housing section 14 at the other end of the rotor shaft 18. One or more ends of the rotor shaft 18 can be formed integrally with the associated turbine rotor 17 and/or a compressor rotor 22 or can be attached thereto by any means that can permit thermal conductivity and thermal transfer between the rotor shaft 18 and the associated turbine rotor 17 and/or the compressor rotor 22. It is also known to extend the rotor shaft 18 into a second compressor or turbine housing (not shown) where desired or required.

The turbine housing section 12 comprises at least one exhaust gas supply channel 24 for supplying exhaust gas conveyed from an internal combustion engine (not shown) to the turbine rotor 17. The exhaust gas supply channel 24 can be configured to extend annularly through the turbine housing section 12 at an orientation generally axial to the axis of rotation R, if desired. The compressor rotor 22 is mounted on one end of the rotor shaft 18 opposed to the turbine rotor 17. During operation of the turbocharger 10, the compressor rotor 22 is driven by the turbine rotor 17 via the rotor shaft 18. The compressor rotor 22 draws air in through a suitable channel, such as an air supply channel 26, compresses the air, and passes the compressed air out through a compressed air discharge channel 28. Channels, such as the exhaust gas supply channel 24, the air supply channel 26, and the compressed air discharge channel 28, can be integrally defined in the housing 11 where desired or required. The various channels 24, 26, 28 can also be positioned in an orientation that is generally axial to the axis of rotation R.

The rotor shaft 18 is rotatably supported by a suitable bearing arrangement 30 that can include a suitable lubricant supply apparatus, such as nipple N, that delivers suitable lubricating material to the bearing arrangement 30 via bores 32, 34 defined in the housing 11. In certain configurations, the bearing arrangement 30 can include suitably configured channel bearings.

Figure 2:
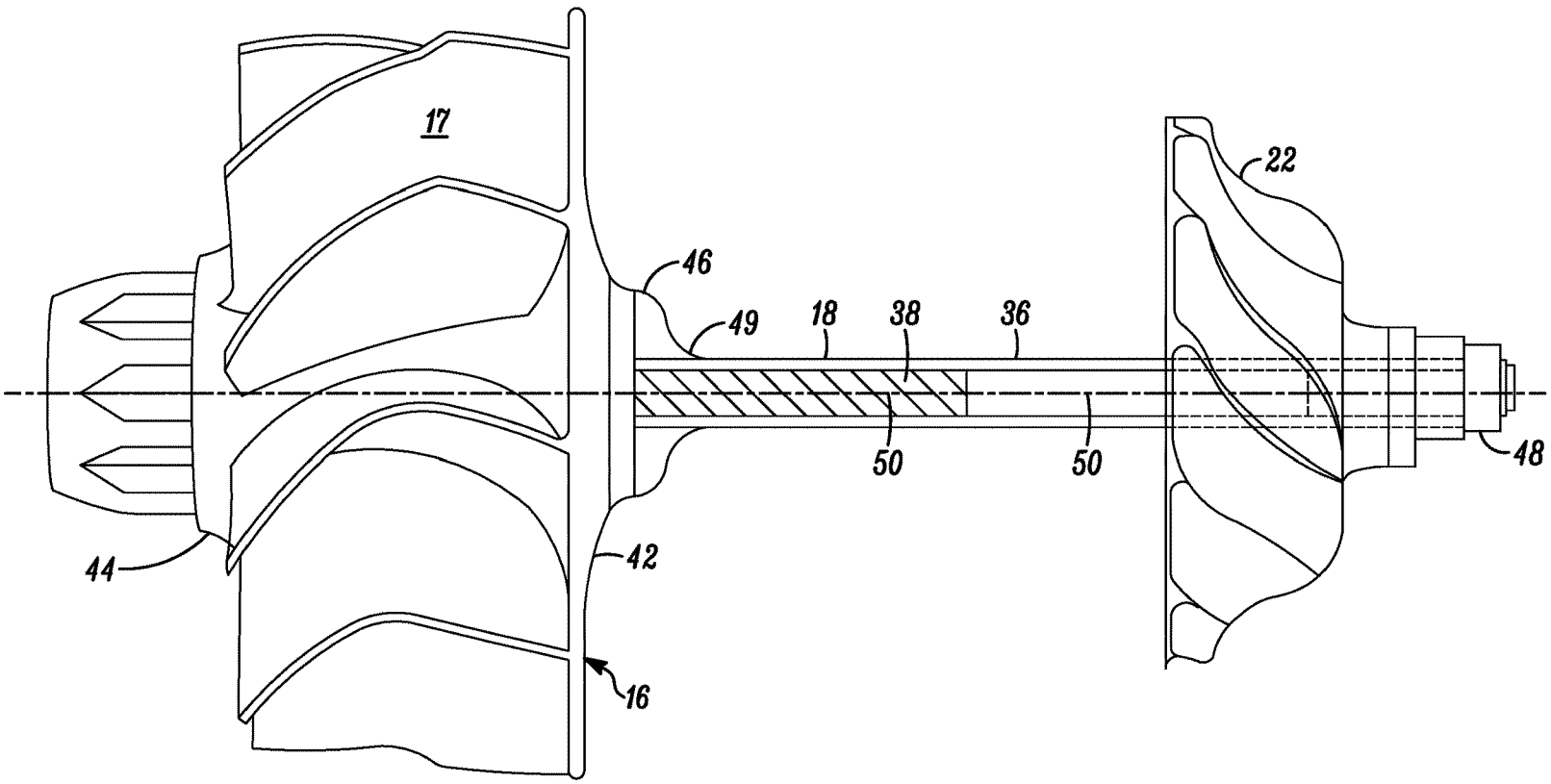
FIG. 2 is side view of a turbocharger rotor according to an embodiment as disclosed herein.

As depicted in FIG. 2, the turbine rotor assembly 16 is composed of the turbine rotor 17 and the rotor shaft 18. The turbine rotor 17 has a first face 42, an opposed second face 44, and a central body 46 interposed therebetween. The rotor shaft 18 is a substantially tubular member having an exterior surface 36 and an interior chamber 38. The interior chamber 38 is defined in at least a portion of the rotor shaft 18.

The turbine rotor 17 and the rotor shaft 18 are joined to one another in any suitable manner that will permit or facilitate heat transfer from the turbine rotor 17 to the rotor shaft 18. In the embodiment depicted in FIG. 2, the rotor shaft 18 projects from the first face 42 of the turbine rotor 17 in a substantially perpendicular orientation. The rotor shaft 18 has a first end 49 and an opposed second end 48. The rotor shaft 18 is connected to the first face 42 of the turbine rotor assembly 16 such that the first end 49 of the rotor shaft 18 is proximate to the turbine rotor 17. The rotor shaft 18 can extend into the central body 46 of the turbine rotor assembly 16. In the embodiment depicted, the central body 46 of the turbine rotor 17 extends from a region proximate to the rotor shaft 18 to a location generally associated with the outer periphery of the turbine rotor 17.

In certain embodiments, the interior chamber 38 defined in at least a portion of the rotor shaft 18 can be configured as a substantially cylindrical shaft that extends from a location proximate to the first end 49 of the rotor shaft 18 to a location distal thereto. This distal location can be proximate to the second end 48 of the rotor shaft 18 or can be a location intermediate between the first end 49 and the second end 48 of the rotor shaft 18. In certain embodiments, it is contemplated that the interior chamber 38 can extend in the rotor shaft 18 to a distance at least medial between the turbine rotor 17 and the compressor rotor 22, while in other embodiments, the interior chamber 38 can extend to a location that is proximate to the compressor rotor 22. In certain embodiments, the interior chamber 38 extends to a location within the body of compressor rotor 22 as depicted in FIG. 2.

The interior chamber 38 contains a thermal transfer material 50 sealed in the interior chamber 38 of the rotor shaft 18. The thermal transfer material 50 is solid at room temperature and liquefiable at or near the temperature at which the associated turbocharger 10 operates. In certain embodiments, the thermal transfer material 50 is selected from a material that will exhibit a high degree of thermal conductivity and/or heat transfer in order to facilitate cooling of the turbine side of the turbine rotor assembly 16 such as the turbine rotor 17. The thermal transfer material 50 employed is one that will have a melting point between 20° C. and 180° C. and a boiling point greater than 750° C., with a melting point between 75° C. and 150° C. being employed in certain applications. When in the liquid state, the thermal transfer material 50 can transfer heat from the turbine rotor 17 to the region associated with the compressor rotor 22. The transferred heat can be dispersed with exiting compressed gas transferring heat from the turbocharger 10 and the associated turbine rotor assembly 16.

The thermal transfer material 50 employed can be comprised of suitable metals, metal alloys, or metal compounds that exhibit a melting point and boiling point in the specified range. Non-limiting examples of suitable thermal transfer materials include potassium, lithium, sodium, selenium, indium as well as alloys containing tin and bismuth either alone or in combination with other materials and alloys such as those containing tin and/or lead. Where the thermal transfer material consists essentially of a single metal, in certain embodiments the single metal can be an alkali earth metal such as lithium, potassium or sodium. In some embodiments as disclosed herein, the thermal transfer material can be sodium.

Suitable bismuth-tin alloys include alloys in which the bismuth is present as the major amount in combination with lesser amounts of tin. The bismuth component can be present in the bismuth-tin alloy in an amount between 42 wt. % and 60 wt. %. Bismuth-tin alloys disclosed herein can include tin as the secondary metal alone or in combination with one or more tertiary metals. Where the tin component is present as the sole secondary metal component, the bismuth component can be present in an amount between 55 wt. % to 60 wt. % with the balance of the alloy being composed of metallic tin. Where the tin component is present in the alloy in combination with at least one tertiary component, the bismuth component can be present in an amount between 50 wt. % and 55wt. %; the tin component can be present in an amount between 15 wt. % and 23 wt. %; with the balance composed of the tertiary metal with or without minor amounts of impurities. Non-limiting examples of tertiary metals include at least one of indium, lead, cadmium, thallium, gallium, antimony. Non-limiting examples of suitable alloys are Newton's metal (Bi 50 wt. %, Pb 31.2 wt. %, Sn 18.8 wt. %), Rose's metal (Bi 50.0 wt. %, Pb 28.0 wt. %, Sn 22.0 wt. %), Wood's metal (Bi 50.0 wt. %, Pb 25.0 wt. %, Sn 12.5 wt. %, Cd wt. %), Lipowitz's alloy (Bi 49.5 wt. %, Pb 27.3 wt. %, Sn 13.1 wt. %, Cd 12.5 wt. %), Cerrobend (Bi 50.0 w.t %, Pb 26.7 wt. %, Sn 13.3 wt. %, Cd 10.1 wt. %), Cerrosafe (Bi 42.5 wt. %, Pb 37.7 wt. %, Sn 11.3 wt. %, Cd 8.5 wt. %). Other non-limiting examples of such alloys include alloy materials composed of Bi 52.5 wt. %, Pb 32.0 wt. % and Sn 15.5 wt. %, alloy materials composed of Bi 56.5 wt. % and Pb 43.5 wt. %, alloy materials composed of Bi 57 wt. % and Sn 43 wt. %.

Suitable tin-lead alloys include alloys in which the tin component is present in an amount between 55 wt. % and 65 wt. % with a secondary metal component such as lead present in an amount between 45 wt. % and 35 wt. %.

The volume of the thermal transfer material 50 present in the interior chamber 38 of the rotor shaft 18 has a volume less than the volume of the interior chamber 38. In certain embodiments, the volume of the thermal transfer material 50 in its solid state is between 30% and 80% of the volume of the interior chamber 38 of the rotor shaft 18, with volumes between 50% and 75% being employed in certain embodiments.

Figure 3:
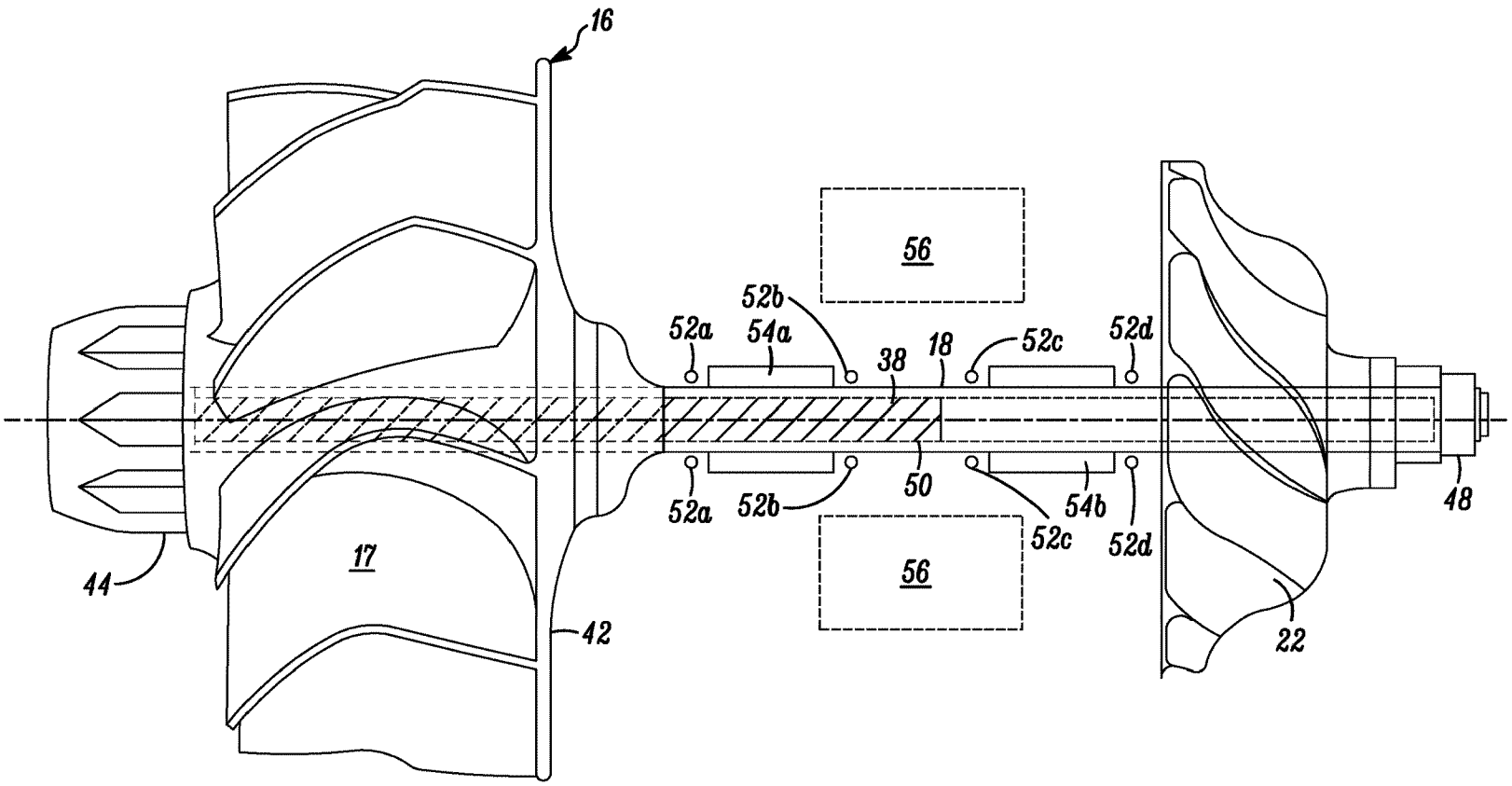
FIG. 3 is schematic view of the turbocharger rotor of FIG. 2 with associated seals and journal bearings.

Referring now to FIG. 3, during operation of the turbocharger 10, the turbine rotor assembly 16 and the compressor rotor 22 rotate at the axis of rotation Rat speeds that can reach up to 250,000 rpm, as heated exhaust contacts the turbine rotor 17 to initiate and sustain rotation. It has been found that the temperature of the turbine rotor 17 can reach temperatures above 700° C. and even above 1000° C. in certain applications.

The turbocharger 10 is configured with suitable seals such as annular seals 52*a*, 52*b*, 52*c*, 52*d* to isolate the turbine and exhaust compartments from each other and, if need be, from elements such as journal bearings 54*a*, 54*b* and the like. The seals 52*a*, 52*b*, 52*c*, 52*d* are composed of a suitable deformable material such as elastomeric materials and the like. Elastomeric materials employed can decompose at temperature values between about 150° C. and 200° C. The turbine rotor assembly 16 rotates around the axis of rotation R, as the rotor shaft 18 rides on the journal bearings 54*a*, 54*b*. The journal bearings 54*a*, 54*b* are lubricated by engine oil that may decompose at temperatures in the range of 125° C. to 200° C.

The turbocharger 10 can also be configured with one or more engine coolant passages 56 that circulate engine coolant fluid to transfer heat from the turbine rotor assembly 16. In the embodiment depicted in FIG. 3, the engine coolant passages 56 are defined in the housing 11 generally proximate to the rotor shaft 18.

As disclosed, the turbocharger 10 is configured with the turbine rotor assembly 16 as disclosed having the thermal transfer material 50 disposed in the interior chamber 38 of the rotor shaft 18. In certain embodiments, the thermal transfer material 50 employed is one that is solid at room temperature and liquefies as heated exhaust gas is channeled into contact with the turbine rotor 17 to initiate turbine rotation to drive the turbine rotor assembly 16 and the associated compressor rotor 22. The thermal transfer material 50 present in the rotor shaft 18 can liquefy at a temperature that is generally at or below the temperature at which thermal degradation of one or more of the materials associated with the seals 52*a*, 52*b*, 52*c*, 52*d* and/or the journal bearings 54*a*, 54*b* occurs, for example, between about 20° C. and 180° C. As the rotor shaft 18 continues to rotate, the temperature of the turbine rotor 17 rises with the continued introduction of heated exhaust gas, and the thermal transfer material 50 contained in the interior chamber 38 of the rotor shaft 18 begins to liquefy, as the temperature of the turbine rotor 17 reaches, and possibly exceeds, the melting point temperature of the thermal transfer material 50. Excess heat is conducted from the regions of the rotor shaft 18 that are proximate to heat sensitive elements such as the seals 52*a*, 52*b*, 52*c*, 52*d* and/or the journal bearings 54*a*, 54*b*.

Figure 4:
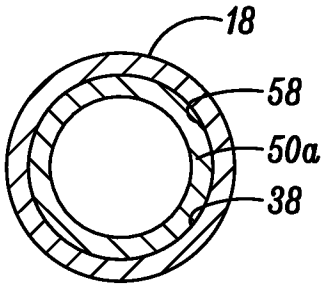
FIG. 4 is a cross-sectional view of the rotor shaft of FIG. 2 during turbocharger operation.

In operation, the liquefied thermal transfer material 50 can be brought into position against the inner wall surface 58 of the interior chamber 38 of the rotor shaft 18 by centrifugal force generated by rotation of the turbine rotor assembly 16 during operation of the turbocharger 10. This produces a liquid thermal transfer material layer 50*a*. In certain embodiments, the liquid thermal transfer material layer 50*a* formed during operation of the turbocharger 10 can be distributed axially along at least a portion of the inner wall surface 58 of the interior chamber 38 of the rotor shaft 18 in the manner depicted in FIG. 4. In such configurations, it is believed that the liquefied thermal transfer material 50 experiences centrifugal force due to the continued rotation of the rotor shaft 18 during operation of the turbocharger 10 and is urged into orientation in contact against the inner wall surface 58 of the rotor shaft 18. Thus, the thermal transfer material 50 present in the rotor shaft 18 will provide a cross sectional configuration in which at least a portion of the rotor shaft 18 includes thermal transfer material 50 axially disposed around a central air gap.

Figure 5:
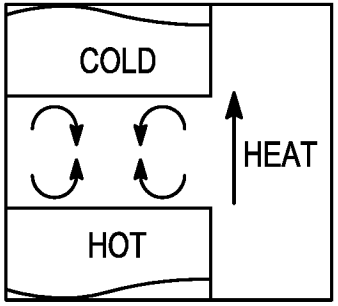
FIG. 5 is a schematic diagram of theoretical convection heat flow according to an embodiment as disclosed herein.

In operation, it is believed that heat transferred from the turbine rotor 17 and any temperature-sensitive associated turbocharger elements such as seals 52*a*, 52*b*, 52*c*, 52*d* and/or journal bearings 54*a*, 54*b* is accomplished in whole or in part by conduction, convection (as shown in FIG. 5), or a combination of the two. Conductive heat transfer involves progressive transfer of heat from the turbine rotor 17 into and through the structure of the rotor shaft 18 and on to the compressor rotor 22 where it can be dissipated into the compressed gas exiting the turbocharger 10. The temperature of the compressed gas provided will be within ranges suitable for intake into the associated engine (not shown) without unduly compromising engine performance. Where desired or required, the temperature of the compressed gas can be further regulated by suitable accessory devices such as intercoolers and the like (not shown).

During operation of the turbocharger 10, the thermal transfer material 50 facilitates the conduction of heat away from the regions of elevated temperature typically found at the turbine rotor 17 and associated regions through the rotor shaft 18 to the body of the associated compressor rotor 22 where air intake into the compressor region can further facilitate heat transfer and dissipation from the compressor rotor 22 into the now-pressurized air as it exits the compressor rotor 22. Because the thermal transfer material 50 has a thermal conductivity greater than the thermal conductivity of the material of construction of the rotor shaft 18, heat transfer preferentially occurs through the thermal transfer material 50 resident in the interior chamber 38 of the rotor shaft 18 over the material in the walls of the rotor shaft 18. The thermal differential that exists between elevated temperatures experienced of materials in and proximate to the turbine rotor 17 and the relatively lower temperature of the thermal transfer material 50, as well as the regions of the turbine rotor assembly 16 that are distal thereto, allow heat to be conveyed linearly away from the turbine rotor 17 through the walls of the rotor shaft 18. Heat is also conveyed from the heated walls of the rotor shaft 18 into the cooler thermal transfer material 50 contained in and in thermal contact with the inner surface 58 of the walls of the rotor shaft 18. Once conveyed to the thermal transfer material 50, heat is preferentially conducted through the thermal transfer material 50 to a suitable terminus. Thus, while it is contemplated that heat can be conveyed through the body of the rotor shaft 18 contemporaneous with conveyance through the thermal transfer material 50, the higher thermal conductivity of the thermal transfer material 50 will facilitate the preferential heat transfer to the thermal transfer material 50 throughout the length of the rotor shaft 18, thereby regulating the temperature at which the rotor shaft 18 operates.

The configuration as disclosed can also facilitate axial heat transfer. In axial heat transfer, at least a portion of the heat experienced in the walls of the rotor shaft 18 is conveyed away from the outwardly oriented surface of the rotor shaft 18 to the thermal transfer material 50. Because of the higher heat conductivity of the thermal transfer material 50, the axially transferred heat can be conveyed linearly through the thermal transfer material 50 from regions of elevated temperature through to lower temperature regions.

The thermal transfer material 50 can be located in the interior chamber 38 of the rotor shaft 18 in a manner that will facilitate thermal transfer. In the embodiment depicted in FIG. 2, the interior chamber 38 is positioned in the rotor shaft 18 at a location that extends from a location proximate to the turbine rotor 17 to a location distal thereto. The distal location can be any point in the associated rotor shaft 18 that is at least medial to the length of the rotor shaft 18. In the embodiment depicted in FIG. 2, the interior chamber 38 extends from a location proximate to the turbine rotor 17 to a location coaxial with the body of the compressor rotor 22. It is contemplated that the interior chamber 38 can project into the rotor shaft 18 onto a region that is coaxial to the turbine rotor 17 in certain embodiments. Similarly, it is contemplated that the interior chamber 38 can be configured as a sealed shaft that extends to the second face 44 of the central body 46 of the turbine rotor 17. Sealing can be accomplished by various suitable methods including, but not limited to, friction welding or electron beam welding to form a seal element proximate to the second end 48 of rotor shaft 18. It is also contemplated that the interior chamber 38 of the rotor shaft 18 can be formed by methods such as hollow forging or the like.

The volume $V_C$ of the interior chamber 38 of the rotor shaft 18 is typically defined by the structure and size of the rotor shaft 18 and associated turbocharger 10 taking into account considerations such as the material of construction and the strength and durability requirements particular to the specific device. The volume $V_T$ of the thermal transfer material 50 contained in the interior chamber 38 of the rotor shaft 18 may be between 40% and 95% of the value of volume $V_C$ of the interior chamber 38 of the rotor shaft 18. In certain embodiments, it is contemplated that the volume $V_T$ of the thermal transfer material 50 will be between 50% and 75% of the value of $V_C$ The thermal transfer material 50 is in thermal contact with at least a portion of the surrounding rotor shaft 18. As used herein, thermal contact includes direct physical contact between the thermal transfer material 50 and the inner wall surface 58 of the interior chamber 38 of the rotor shaft 18 over a sufficient area to facilitate and promote the heat transfer as previously outlined. In embodiments where the thermal transfer material 50 remains in its solid state during the operation of the turbocharger 10, the thermal transfer material 50 can be configured as a substantially cylindrical member having an outer circumferential surface in abutting contact with the inner wall 58 of the rotor shaft 18. In embodiments where the thermal transfer material 50 liquefies as the turbocharger 10 approaches its operating temperature, the liquefied thermal transfer material 50 can flow to coat the inner surface 58 of the interior chamber 38 of the rotor shaft 18 in a manner that provides a thickness that is generally homogeneous in an axial direction. The thermal transfer material 50 can flow into a homogenous lateral direction or can have a tapering thickness depending on the relative volumes of the interior chamber 38 of the rotor shaft 18 and the thermal transfer material 50 employed.

It is also believed that axial heat transfer can also occur in certain embodiments such that heat is transferred from the compressor rotor 22 by the liquefied thermal transfer material 50.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A turbocharger rotor shaft assembly comprising:

at least one turbine rotor member having a first face and an opposed second face;

a rotor shaft having a first end and an opposed second end distal to the first end, wherein the rotor shaft is connected to the at least one turbine rotor member at a location proximate to the first end and projects outward from the first face of the turbine rotor member, the rotor shaft having an outwardly oriented face and an interior chamber defined therein, the interior chamber having an interior chamber volume, wherein the rotor shaft is composed of a material having a first thermal conductivity value; and at least one thermal transfer material positioned in the interior chamber of the rotor shaft, the thermal transfer material having second thermal conductivity value, wherein the second thermal conductivity value is greater than the first thermal conductivity value, the at least one thermal transfer material being adapted for liquefication at an operating temperature of the turbocharger such that the at least one transfer material transitions from a solid state to a liquid state during operation of the turbocharger.

2. The turbocharger rotor shaft assembly of claim 1 wherein the thermal transfer material has a volume that is between 50% and 75% of the volume of the interior chamber of the rotor shaft when the thermal transfer material is in a solid state.

3. The turbocharger rotor shaft assembly of claim 1 wherein the thermal transfer material is one of an alkali earth metal, a metal alloy or mixtures thereof.

4. The turbocharger rotor shaft assembly of claim 3 wherein the thermal transfer material has a melting point between 20° C. and 180° C. and a boiling point greater than 750° C.

5. The turbocharger rotor shaft assembly of claim 4 wherein the thermal transfer material is at least one of the following: sodium, potassium, selenium, indium, bismuth-lead-tin alloys, bismuth-lead alloys, bismuth-tin alloys.

6. The turbocharger rotor shaft assembly of claim 1 wherein the thermal transfer material has a melting point between 75° C. and 150° C.

7. The turbocharger rotor shaft assembly of claim 6 wherein the interior chamber of the rotor shaft extends from a location internal to the turbine rotor member to a location at least medial to the opposed second end of the rotor shaft.

8. The turbocharger rotor shaft assembly of claim 7 wherein the thermal transfer material has a volume when solid that is between 50% and 80% of the volume of the interior chamber of the rotor shaft.

9. The turbocharger rotor shaft assembly of claim 8 wherein the thermal transfer material is sodium.

10. A turbocharger comprising:

a housing having a turbine housing section and a compressor housing section arranged along an axis of rotation;

a rotor shaft assembly having a rotor shaft disposed along the axis of rotation and having a first end and a second end, a turbine rotor connected to the first end of the rotor shaft, and a compressor rotor connected to the second end of the rotor shaft, wherein the compressor rotor is contained in the compressor housing section, and the turbine rotor is contained in the turbine rotor housing section, the rotor shaft having an outwardly oriented surface and an interior chamber defined therein, the interior chamber having an interior chamber volume; and at least one thermal transfer material contained in the interior chamber of the rotor shaft, wherein the rotor shaft is composed of a material having a first thermal conductivity value, and the thermal transfer material is composed of a material having a second thermal conductivity value, the second thermal conductivity value being greater than the first thermal conductivity value, the at least one thermal transfer material being adapted for liquefication at an operating temperature of the turbocharger such that the at least one transfer material transitions from a solid state to a liquid state during operation of the turbocharger.

11. The turbocharger of claim 10 wherein the at least one thermal transfer material has a volume when solid that is between 50% and 75% of the interior chamber volume of the rotor shaft.

12. The turbocharger of claim 10 wherein the thermal transfer material has a melting point between 20° C. and 160° C. and a boiling point greater than 750° C.

13. The turbocharger of claim 12 wherein the thermal transfer material has a melting point between 75° C. and 150° C.

14. The turbocharger of claim 12 wherein the thermal transfer material is at least one of the following: sodium, potassium, selenium, indium, bismuth-lead-tin alloys, bismuth-lead alloys, bismuth-tin alloys.

15. The turbocharger of claim 12 wherein the thermal transfer material is sodium.

16. The turbocharger of claim 10 further comprising at least one channel bearing conveying at least one lubricant and connected to a lubrication source and at least one engine coolant channel conveying an engine coolant material, wherein the interior chamber defined in the rotor shaft is proximate to the at least one engine coolant passage and the at least one channel bearing.

17. The turbocharger of claim 16 wherein the lubricant conveyed through the channel bearing has a degradation temperature and wherein the thermal transfer material has a melting temperature below the degradation temperature of the lubricant.

18. The turbocharger of claim 17 wherein the thermal transfer material is sodium.

19. A turbocharger rotor shaft assembly comprising:

a rotor shaft defining an enclosed interior chamber, the rotor shaft including a first material having a first thermal conductivity value; and at least one thermal transfer material positioned in the interior chamber of the rotor shaft and having a second thermal conductivity value greater than the first thermal conductivity value, the at least one thermal transfer material being adapted for liquefication at an operating temperature of the turbocharger such that the at least one transfer material transitions from a solid state to a liquid state during operation of the turbocharger.

20. The turbocharger rotor shaft assembly of claim 19, wherein the at least one thermal transfer material has a melting point between 20° C. and 180° C. and a boiling point greater than 750° C.

* * * * *